US006480172B1

(12) United States Patent
Sawyer

(10) Patent No.: US 6,480,172 B1
(45) Date of Patent: Nov. 12, 2002

(54) ADJUSTABLE ANTENNA MOUNTING APPARATUS

(75) Inventor: Charlie C. Sawyer, Orlando, FL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 09/467,471

(22) Filed: Dec. 20, 1999

(51) Int. Cl.[7] ..... H01Q 1/12

(52) U.S. Cl. ..... 343/890; 343/874; 343/882; 343/891

(58) Field of Search ..... 343/874, 878, 343/890, 891, 892, 882; 52/40

(56) References Cited

U.S. PATENT DOCUMENTS

| | | | | |
|---|---|---|---|---|
| 110,434 A | | 12/1870 | Clarke | |
| 780,947 A | | 1/1905 | Grabe | |
| 1,303,249 A | | 5/1919 | Brown | |
| 1,522,751 A | | 1/1925 | Sechler | |
| 1,676,524 A | * | 7/1928 | Conrad | |
| 1,935,246 A | | 11/1933 | Kirsch | 304/40 |
| 2,463,176 A | | 3/1949 | Hogrefe | 248/230 |
| 2,575,917 A | | 11/1951 | Johnson | 287/14 |
| 2,611,566 A | | 9/1952 | Landis | 248/44 |
| 2,614,861 A | | 10/1952 | Van Horn | 280/33.15 |
| 2,667,317 A | | 1/1954 | Trebules | 248/43 |
| 2,754,156 A | | 7/1956 | Elderkin | 304/10 |
| 3,208,703 A | * | 9/1965 | Arnold et al. | 248/43 |
| 3,358,952 A | * | 12/1967 | Burns | 248/43 |
| 3,910,561 A | | 10/1975 | Fornells | 256/65 |
| 3,941,340 A | | 3/1976 | Rankins | 248/40 |
| 5,088,672 A | | 2/1992 | Neuendorf et al. | 248/230 |
| 5,581,962 A | * | 12/1996 | Davis et al. | 52/148 |
| 5,664,752 A | | 9/1997 | Matthiessen et al. | 248/299.1 |
| 5,920,291 A | | 7/1999 | Bosley | 343/892 |
| D413,603 S | | 9/1999 | Inoue | D14/231 |
| 6,031,508 A | | 2/2000 | Ishizuka et al. | 343/882 |

* cited by examiner

*Primary Examiner*—Hoanganh Le
*Assistant Examiner*—Shih-Chao Chen
(74) *Attorney, Agent, or Firm*—Kirkpatrick & Lockhart LLP

(57) ABSTRACT

An apparatus and method for rigidly supporting an antenna mast or other object relative to a structure in a desired position. The apparatus may comprise a first bracket that is affixable to the structure and a second bracket that is slidably affixed to the first bracket and capable of being locked in a desired position relative to the first bracket. A mast-supporting or object-supporting collar or clamp may be rotatably and slidably affixed to the second bracket and is capable of being locked in a desired position relative to the second bracket.

33 Claims, 11 Drawing Sheets

ADJUSTABLE ANTENNA MOUNTING APPARATUS

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to mounting devices and, more particularly, to devices for mounting an antenna mast to a variety of different objects and structures.

2. Description of the Invention Background

An antenna is a device used to send or receive electromagnetic waves forming telecommunications, radio, television, and other signals. Antenna assemblies typically include a signal receiver that is mounted to a pole or "mast" that is oriented in an elevated position above ground level to improve the receiver's line-of-sight range.

The antenna mast may be mounted to a variety of different elevated structures such as buildings, poles, towers, trees, etc. to improve the receiver's line-of-sight. To optimize the antenna's reception and transmissibility such that a clear signal is received or sent, the antenna must be precisely positioned or "tuned". Tuning involves the manipulation and alignment of the receiver to a desired position. For example, it is often desirable to mount the receiver such that it is oriented along a true vertical or plumb line. In such installations, if the receiver is not mounted in a true vertical orientation, signal quality may be sacrificed.

Existing antenna mounting apparatuses commonly comprise a rigid bracket that has a mast clamping portion. Such mounting brackets are typically not adjustable and therefore are not well-suited for affixing the antenna mast to a structure that lacks a vertically oriented surface. For example, existing antenna mounting devices are difficult to employ when it is desirable to mount the antenna mast to an arcuate tree limb or other structure that lacks a vertically oriented surface.

Thus there is a need for an antenna mounting apparatus that can be used to mount an antenna to a variety of different structures, such as elevated buildings, trees, etc.

There is a further need for an antenna mounting apparatus that can be easily adjusted during installation to align the antenna in a desired orientation.

Another need exists for an antenna mounting apparatus that can be easily used to affix an antenna mast to a tree limb or other structure that does not have a vertically oriented surface.

There is still another need for an antenna mounting apparatus that has the above-mentioned characteristics and that is easy to manufacture and install.

Yet another need exists for an antenna mounting apparatus that is manufactured from corrosion resistant materials.

Another need exists for an antenna mounting apparatus that has the above-mentioned characteristics that can be easily installed and adjusted with common hand tools.

Still another need exists for a device for mounting an object to a structure that is readily adjustable such that the object may be supported in a desired orientation relative to the structure.

SUMMARY OF THE INVENTION

In accordance with one form of the present invention, there is provided apparatus for mounting an antenna mast or other object to a structure in a desired orientation. In one embodiment, the apparatus comprises a first bracket attachable to the structure. A second bracket is slidably and lockably affixed to the first bracket. A mast-supporting or object-supporting collar is movably affixed to the second bracket. In one embodiment, the mast-supporting or object-supporting collar is rotatably affixed to the second bracket such that it can be selectively positioned about an axis of rotation relative to the second bracket to a desired supporting position and thereafter locked in that position. In another embodiment of the present invention, the mast-supporting or object-supporting collar may be slidably affixed to the second bracket such that the collar may be selectively laterally positioned on the second bracket to a desired orientation. In yet another embodiment of the present invention, the mast-supporting or object-supporting collar is rotatably and slidably affixed to the second bracket such that it may be selectively oriented about an axis of rotation and moved laterally along an axis to a desired orientation and thereafter locked in that orientation.

Another embodiment of the subject invention comprises a first mounting bracket attachable to a structure and a mast-supporting or object-supporting collar rotatably affixed to the first mounting bracket for selective rotation about a first axis to a desired position. A collar lock member is employed to lock the collar in that desired position.

The embodiments of the subject invention may be fabricated from bendable materials that permit various components of the subject mounting apparatuses to conform to the shape and size of the particular structure or member to which it is to be mounted. For outdoor applications, the mounting apparatuses may be fabricated from corrosion-resistant materials. Other embodiments of the subject invention employ fasteners that are easily adjusted by common hand tools. If desired, all of the fasteners employed by the subject invention may be of a common size such that a single hand tool could be used to complete the adjustments and installation of the apparatus. Multiple apparatuses may be advantageously used to support elongated masts and other objects.

Thus, the subject invention represents a vast improvement over prior antenna mounting devices. Moreover, the unique and novel aspects of the mounting apparatus of the subject invention make it particularly well-suited for attaching a variety of differently shaped objects to a structure or other member.

It is a feature of the present invention to provide an antenna mounting apparatus that can be used to mount an antenna to a variety of different structures, such as elevated buildings, trees, etc.

It is another feature of the subject invention to provide an antenna mounting apparatus that can be easily adjusted during installation to align the antenna in a desired orientation.

Yet another feature of the subject invention is to provide an antenna mounting apparatus that can be easily used to affix an antenna mast to a tree limb or other structure that does not have a vertically oriented surface.

Another feature of the subject invention is to provide an antenna mounting apparatus that has the above-mentioned characteristics and that is easy to manufacture and install.

Still another feature of the subject invention is to provide an antenna mounting apparatus that is manufactured from corrosion resistant materials.

Another feature of the subject invention is to provide an antenna mounting apparatus that has the above-mentioned characteristics that can be easily installed and adjusted with common hand tools.

It is another feature of the subject invention to provide a device for mounting an object to a structure that is readily adjustable such that the object may be supported in a desired orientation relative to the structure.

Accordingly, the present invention provides solutions to the shortcomings of prior mounting devices. Those of ordinary skill in the art will readily appreciate, however, that these and other details, features and advantages will become further apparent as the following detailed description of the preferred embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
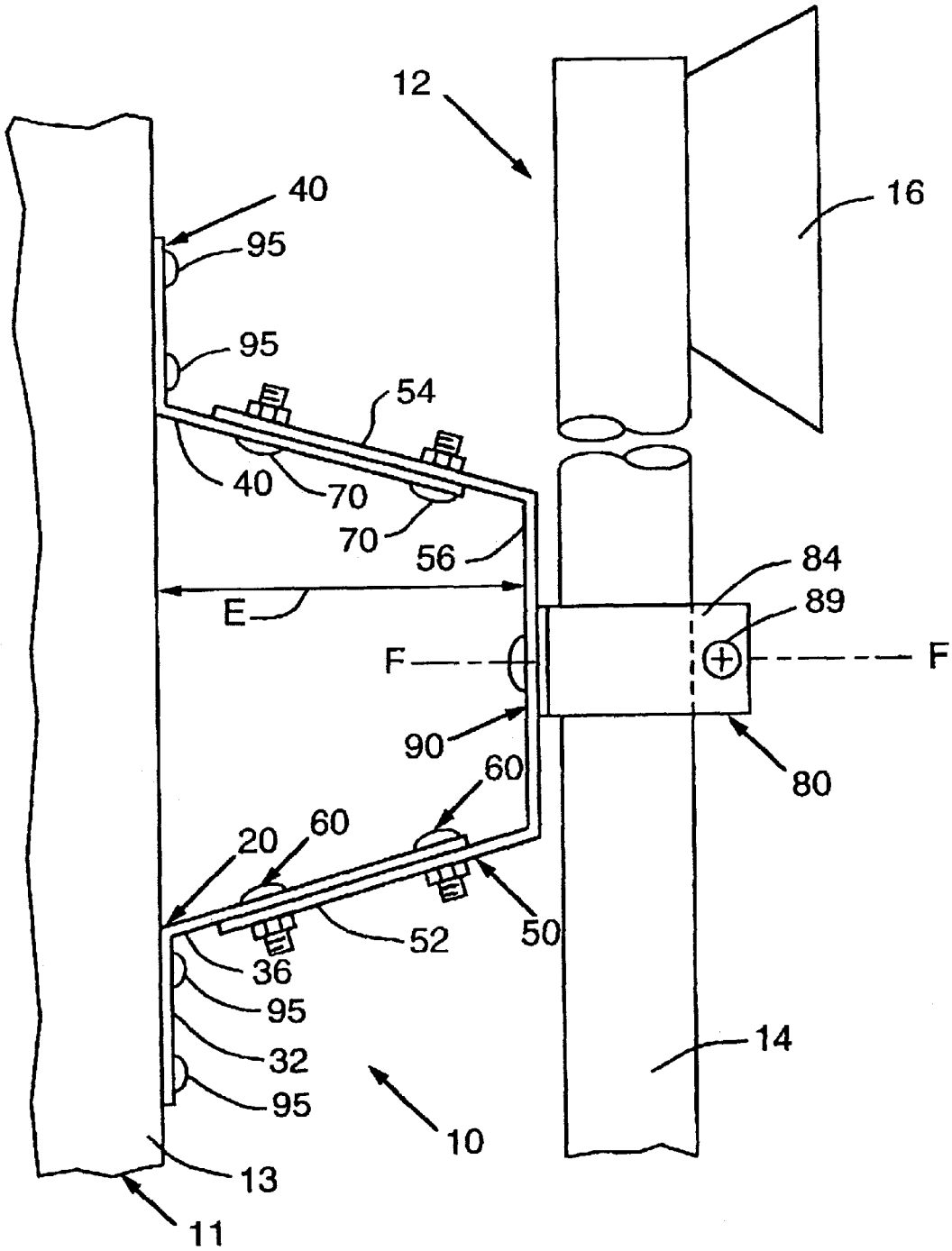
FIG. 1 is a side view of a mounting apparatus of the present invention attached to a structure and supporting an antenna mast therein.

Referring now to the drawings for the purposes of illustrating the present embodiments of the invention only and not for the purposes of limiting the same, the Figures illustrate a mounting apparatus 10 for mounting the mast 14 of an antenna assembly 12 to a structure 11. As can be seen in FIG. 1, the antenna assembly 12 comprises a mast 14 and at least one signal receiver 16 that is affixed to the mast 14. A variety of different signal receivers (i.e., telecommunications, radio, television, microwave, etc.) are known in the art and, therefore, the construction of receiver 16 and its attachment to mast 14 will not be discussed herein. The skilled artisan will also appreciate that the mast 14 may comprise a metal pipe or other elongated structure suitable for supporting one or more receivers 16. While the mast 14 is shown herein as having a circular cross-sectional shape, it will be readily appreciated that the subject invention may be employed to support a variety of different mast configurations and shapes without departing from the spirit and scope of the present invention.

The subject invention will be described herein in connection with the mounting of an antenna assembly to a structure. FIG. 1 depicts a mounting apparatus 10 of the subject invention affixed to a vertically extending wall 13 of a structure 11. The structure 11 may comprise an exterior portion of a building, a tower, or other elevated structure. The subject invention is equally well-suited for use with a variety of other "structures" such as trees or other objects that lack a vertically oriented surface. Thus, as used herein, the term "structure" should not be limited to a building or other manmade structures, but it can also comprise trees or any other member to which it may be desirable to attach an antenna or other object thereto. It will also be readily apparent to the reader that the unique and novel aspects of the subject invention enable it to be used in a variety of different applications and settings wherein it is desirable to adjustably and rigidly affix a myriad of other objects to a structure in a desired orientation. Thus, the subject invention should not be limited solely to use in connection with antenna assemblies.

Figure 6:
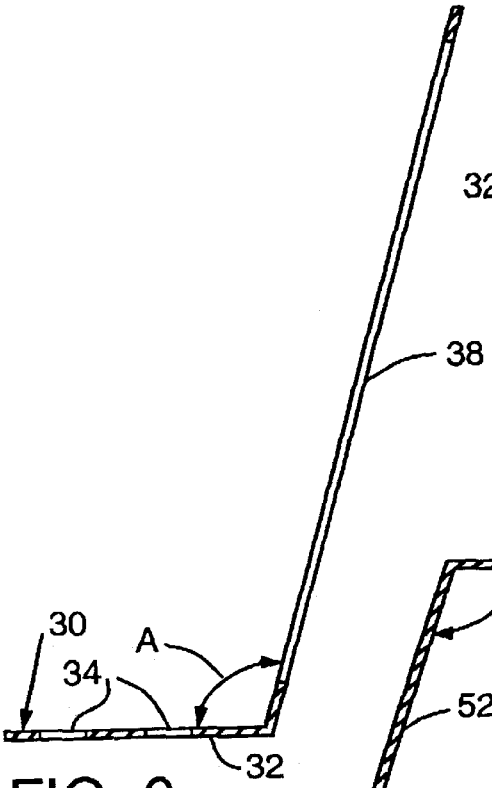
FIG. 6 is a cross-sectional side view of the mounting leg of FIG. 5.
Figure 9:
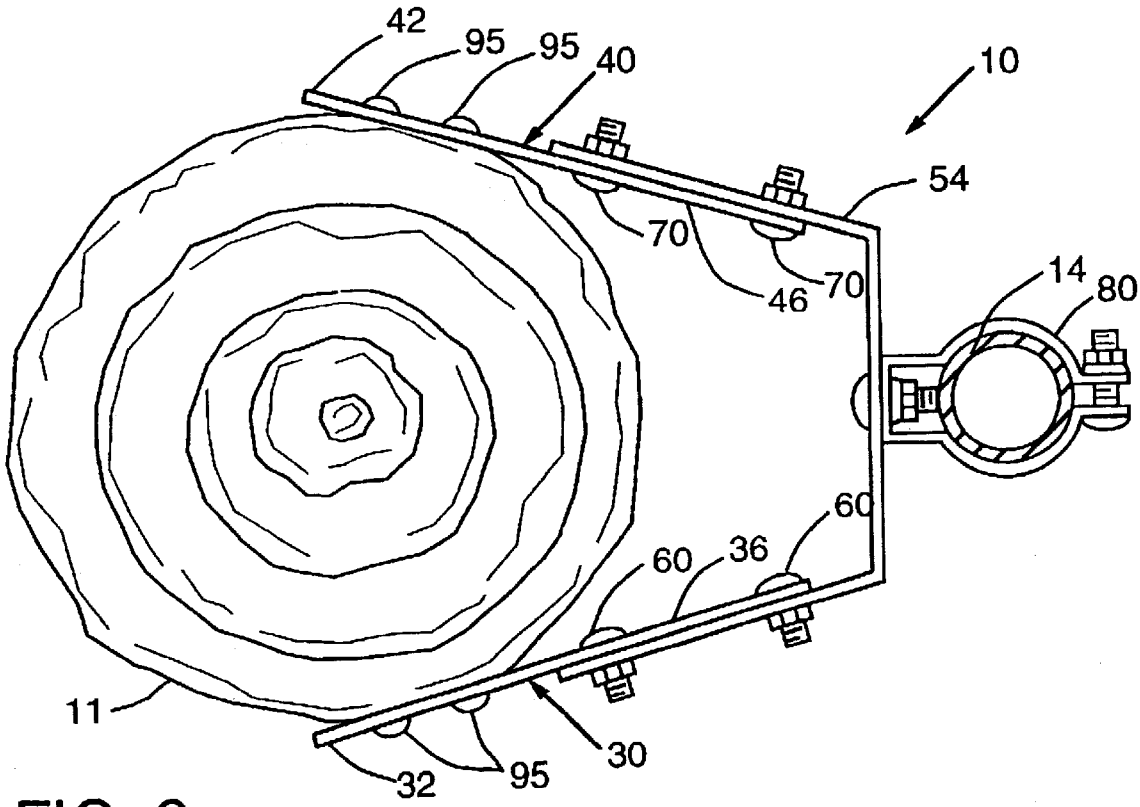
FIG. 9 is a top view of an another embodiment of the present invention attached to a portion of a structure in the form of a tree limb.
Figure 12:
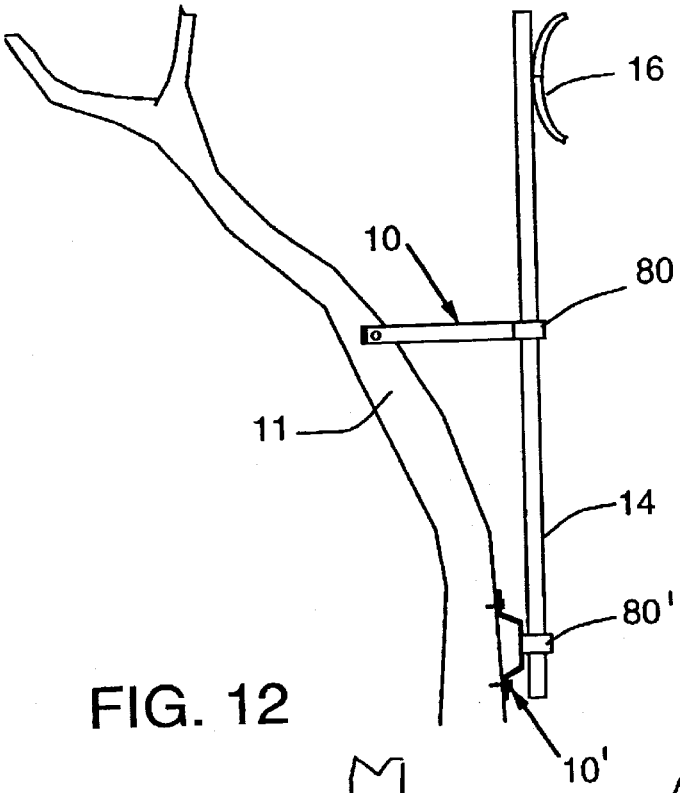
FIG. 12 is another side view of a tree limb and a pair of mounting apparatuses of the present invention supporting an antenna mast.
Figure 11:
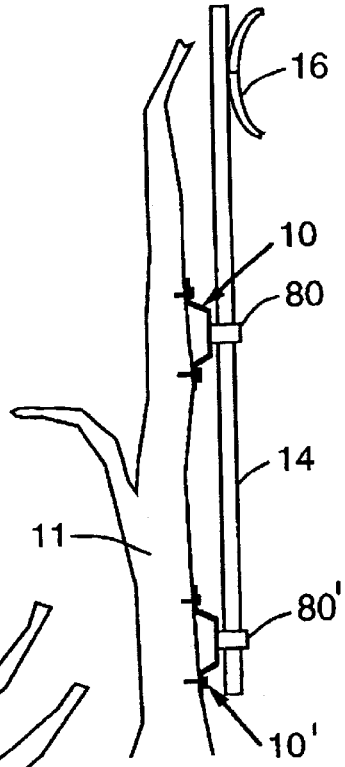
FIG. 11 is another side view of a tree limb and a pair of mounting apparatuses of the present invention supporting an antenna mast.

The embodiment of mounting apparatus 10 of the subject invention depicted in FIGS. 1–4 comprises a first bracket 20 that is attachable to the structure 11. The first bracket 20 comprises a first mounting leg 30 and a second mounting leg 40. The first mounting leg 30 includes a first structure attachment portion 32 that contains at least one fastener hole 34 therethrough. See FIGS. 5 and 6. In the embodiment depicted in FIGS. 1–6, two fastener holes 34 are provided. First mounting leg 30 further includes a first extension 36 that has a first slot 38 therethrough. Depending upon the application, the first extension 36 may be oriented at a first angle "A" relative to the first structure attachment portion 32. See FIG. 6. In one embodiment, angle "A" is 70°. However, it is conceivable that, depending upon the application, angle "A" could have a variety of different sizes depending upon the size and shape of the structure. For example, as shown in FIG. 9, the first attachment portion 32 may be substantially coplanar with the first extension 36.

The second mounting leg 40 similarly includes a second structure attachment portion 42 that contains at least one fastener hole 44 therethrough. In the embodiment depicted in FIGS. 1–7, two fastener holes 44 are provided. Second mounting leg 40 further includes a second extension 46 that has a second slot 48 therethrough. Depending upon the application, the second extension 46 may be oriented at a second angle "B" relative to the second structure attachment portion 42. In one embodiment, angle "B" is 70°. However, it is conceivable that, depending upon the application, angle "B" could have a variety of different sizes. As shown in FIG. 9, the second structure attachment portion 42 could be coplanar with the second extension 46.

The first and second mounting legs (30, 40) may be fabricated from a selectively bendable material such as, for example, 10 gage metal. In one embodiment, the first and second mounting legs (30, 40) are fabricated from 10 gage galvanized metal which provides resistance to corrosion. It will be appreciated, however, that the first and second mounting legs (30, 40) may be fabricated from a variety of other materials such as, for example, stainless steel and other selectively bendable, materials, etc. The term "selectively bendable" as used herein means that the extension portion of the attachment leg may be selectively bent relative to the structure attachment portion of that attachment leg to alter the angle therebetween without compromising the material's structural integrity and without compromising the material's ability to substantially rigidly support the antenna mast or other object relative to the structure. In other embodiments, the first and second mounting leap may be fabricated from other materials that could not be relatively easily bent in the field. For example, mounting legs (30, 40) could be fabricated from thicker metals, polymers, etc.

As can also be seen in FIGS. 1–4, this embodiment of the mounting apparatus 10 of the subject invention comprises a second bracket 50 that is slidably affixed to the first bracket 20. The second bracket 50 comprises a primary mounting leg 52 that corresponds with the first extension 36 of the first mounting leg 30 and a secondary mounting leg 54 that corresponds with the second extension 46 of the second mounting leg 40. A collar-mounting portion 56 extends between the primary mounting leg 52 and the secondary mounting leg 54. The primary mounting leg 52 is oriented at an angle "C" that is substantially equal to angle "A". Likewise, the secondary leg portion 54 is oriented at an angle "D" that is substantially equal to angle "B".

In the embodiment of FIGS. 1–8, the primary mounting leg 52, the collar attachment portion 56, and the secondary mounting leg 54 are integrally formed from a single piece of selectively bendable material. For example, the second bracket 50 may be fabricated from a single piece of 10 gage galvanized metal or other suitable material. In the alternative, the primary mounting leg 52, the collar mounting portion 56 and the secondary mounting leg 54 may comprise three separate pieces that are mechanically fastened together, such as by welding. The reader will appreciate of course that the second bracket 50 may be fabricated from a variety of different materials of the types described above with respect to the first and second mounting legs (20, 30).

In this embodiment, the primary mounting leg 52 is affixed to the first extension 36 of the first mounting leg 30 by at least one first fastener 60 that extends through the first slot 38 in the first extension 36 and a corresponding mounting hole 53 in the primary mounting leg 52. A total of four mounting holes 53 are provided through the primary mounting leg 52 and two first fasteners 60 are employed to enhance the adjustability of the mounting apparatus 10. However, other quantities of mounting holes 53 and fasteners 60 may be employed. Each first fastener 60 comprises a first carriage bolt 62 and a corresponding self-locking nut 64. Similarly, the secondary mounting leg 54 is affixed to the second angled portion 46 of the second mounting leg 40 by at least one second fastener 70 that extends through the second slot 48 in the second extension 46 and a corresponding mounting hole 72 in the secondary mounting leg 54. While four mounting holes 72 are shown, the reader will appreciate that other quantities of mounting holes 72 and fasteners 70 may be employed. Each second fastener 70 comprises a second carriage bolt 76 and corresponding self-locking washer 78. Those of ordinary skill in the art will appreciate that the second bracket 50 may be slidably affixed to the first and second mounting legs (30, 40) by a myriad of other fastener arrangements without departing from the spirit and scope of the present invention.

Figure 2:
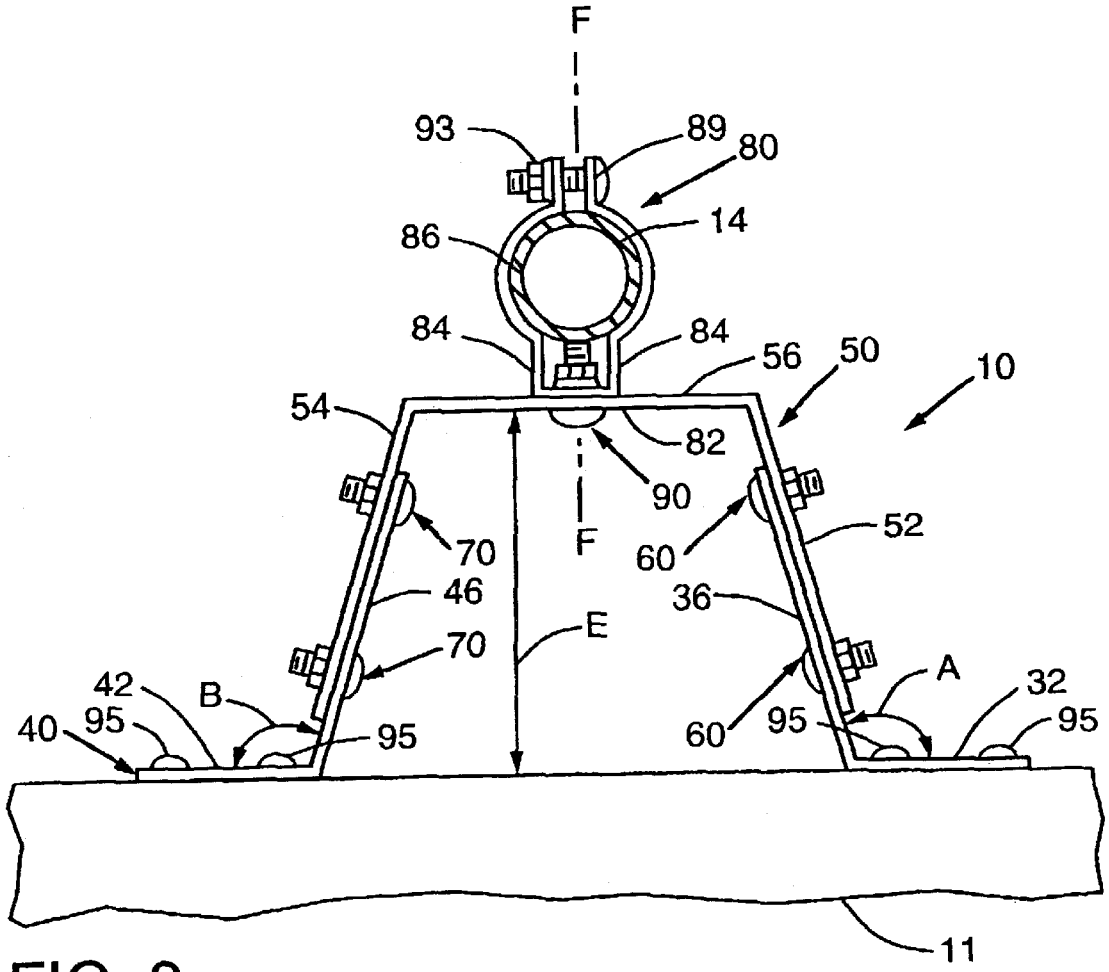
FIG. 2 is a top view of the mounting apparatus and antenna mast of FIG. 1 showing the antenna mast in cross-section.
Figure 4:
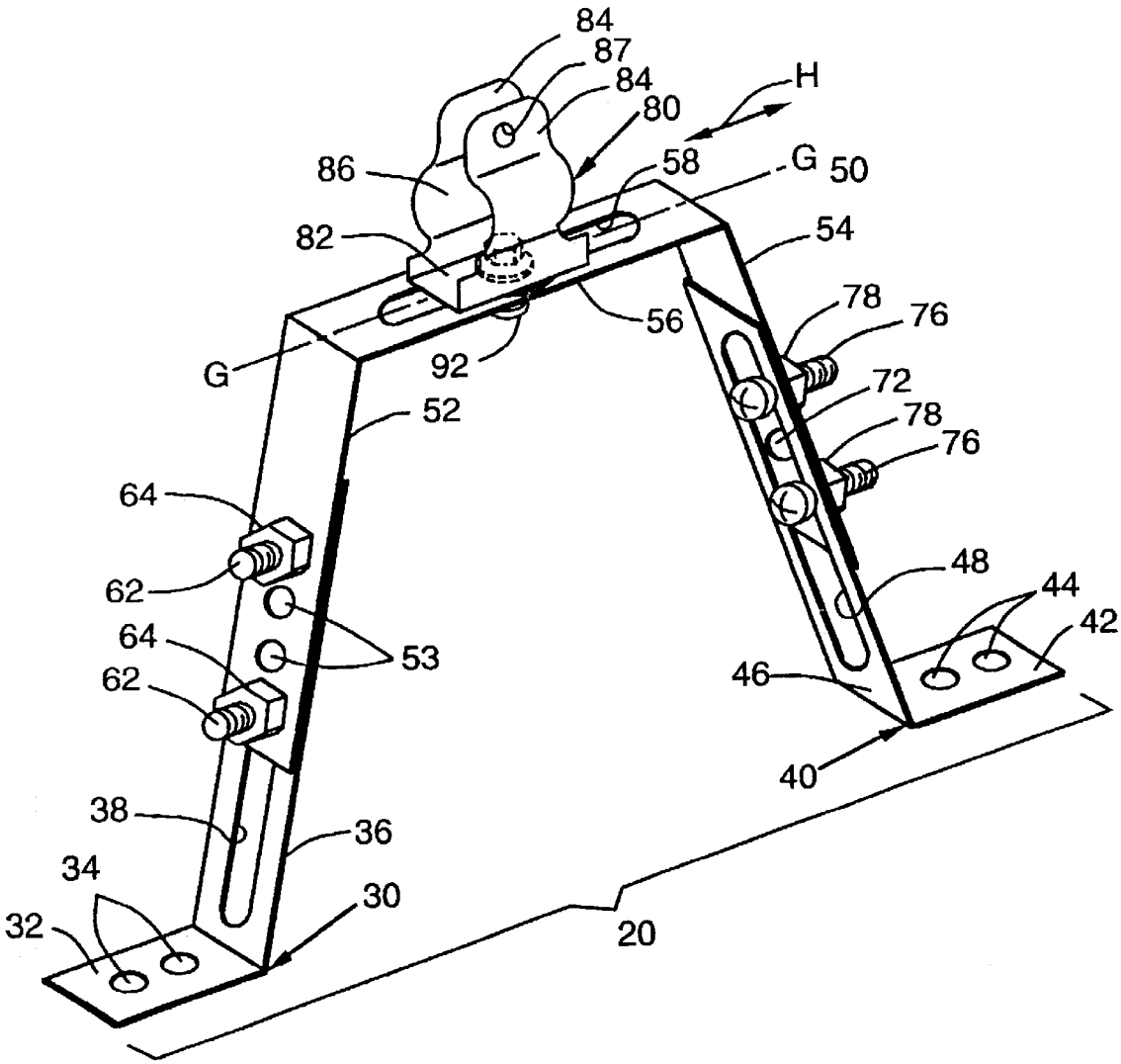
FIG. 4 is a perspective view of the assembled mounting apparatus of FIG. 3.
Figure 5:
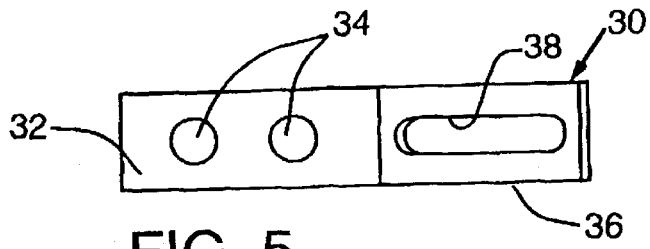
FIG. 5 is a top view of a mounting leg of the assembly apparatus of the present invention.
Figure 8:
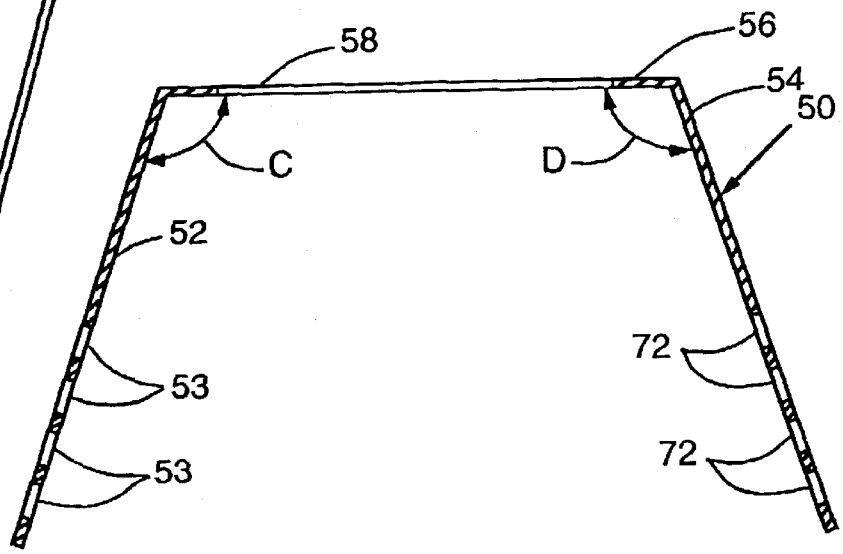
FIG. 8 is a cross-sectional front view of the second bracket depicted in FIG. 7.

When the second bracket 50 is affixed to the first and second mounting legs (30, 40) as shown in FIGS. 1, 2, and 4, the distance between the collar mounting portion 56 of the second bracket 50 and the structure 11 (represented by arrow "E") can be selectively altered by loosening the self locking nuts (64, 78) and sliding the second bracket 50 relative to the first and second mounting legs (30, 40) and thereafter tightening the self locking nuts (64, 78) to retain the second bracket 50 in that locked position.

This embodiment of the mounting apparatus 10 of the present invention further includes a collar or "clamp" 80 that is rotatably and slidably affixed to the collar-mounting portion 56 of the second bracket 50. Collar 80 may also be hereinafter referred to as a "mast-supporting collar" or an "object-supporting collar". As can be seen in FIGS. 1–4, the collar 80 has a base 82 and two clamping arms 84 that define an aperture 86 that corresponds to the perimetrical shape of the mast 14 or other object to be supported. For example, in the embodiment depicted in FIGS. 1 and 2, the mast 14 has a circular-shaped perimeter. Thus, the aperture 86 has a circular shape that is sized to receive a portion of the mast 14 therein. However, if the mast 14 or other object has a square, rectangular, triangular, octagonal, etc. shaped perimeter, the aperture 86 may be provided in a corresponding shape to facilitate rigid clamping of the mast 14 or other object between the clamping arms 84. In this embodiment, the collar 80 is fabricated from corrosion resistant material such as galvanized steel, stainless steel, polymeric material, etc.

Figure 3:
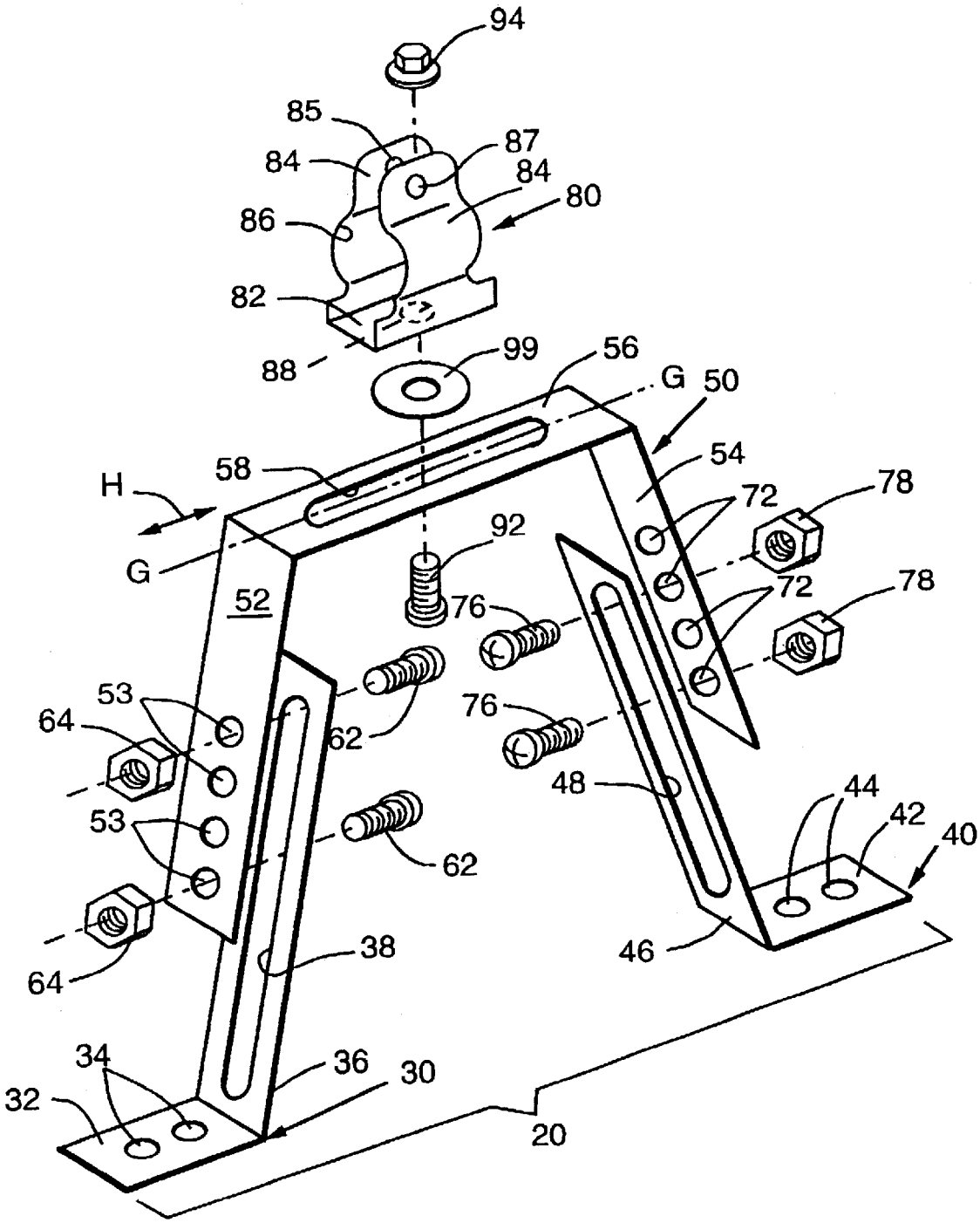
FIG. 3 is an exploded assembly view of a mounting apparatus of the subject invention.
Figure 7:
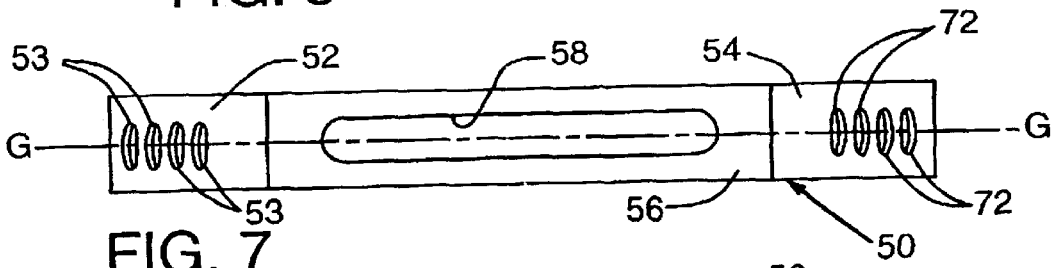
FIG. 7 is a top view of a second bracket portion of the mounting apparatus of the subject invention.
Figure 7A:
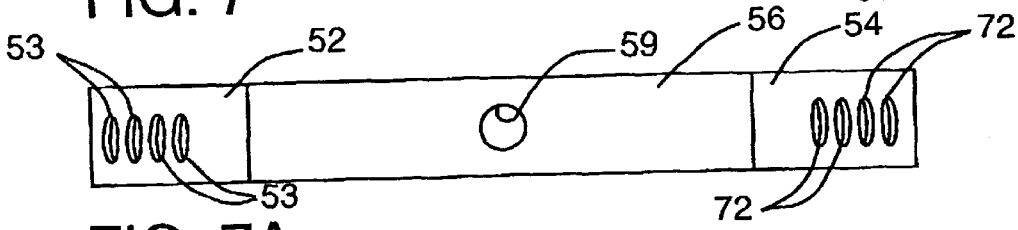
FIG. 7A is a top view of an alternate embodiment of a second bracket of the mounting apparatus of the subject invention.

The collar 80 may be rotatably and slidably affixed to the collar-mounting portion 56 of the second bracket 50 as follows. An elongated collar slot 58 is provided through the collar-mounting portion 56 of the second bracket 50 as shown in FIGS. 3 and 4. A mounting hole 88 is provided through the base 82 of the collar 80. See FIG. 3. A third fastener 90 extends through the collar slot 58 in the second bracket 50 and through the mounting hole 88 in the base 82 of the collar 80. In this embodiment, the third fastener 90 comprises a third carriage bolt 92. A lock nut 94 is threaded onto the carriage bolt 92 to lock the collar 80 in position. Also in this embodiment, a washer 99 is used to provide additional bearing support for the collar 80. As shown in FIGS. 1 and 2, the carriage bolt 92 defines an axis of rotation "F—F" about which the collar 80 can be selectively rotated during installation to orient the collar 80 and, ultimately, the mast 14 or other object clamped thereby in a desired orientation. It will also be appreciated that, prior to tightening the lock nut 94, the collar 80 may be selectively laterally positioned relative to the second bracket 50 along a lateral axis "G—G" (defined by collar slot 58) as represented by arrow "H". Thus, after the collar 80 has been selectively oriented to a desired lateral position along axis G—G, and rotatably oriented about axis F—F to a desired position, the carriage bolt 92 and nut 94 are tightened to lock the collar 80 in that position. The skilled artisan will appreciate that in applications wherein the lateral positioning of the mast-supporting collar 80 is not required, a hole 59 may be provided in the collar-mounting portion 56 instead of the collar slot 58. See FIG. 7A. Likewise, in those applications wherein it may not be necessary to rotate the collar 80 about an axis of rotation, the mounting hole 88 in the base 82 of the mast-supporting collar 80 may be shaped to correspond with a non-circular portion formed on the carriage bolt 92 to prevent rotation of the mast-supporting collar 80 on the carriage bolt 92.

To facilitate clamping of the mast 14 or other object to the mounting apparatus 10, apertures (85, 87) are provided through the clamping arms 84 of the collar 80 as shown in FIGS. 3 and 4. A clamping bolt 89 is inserted through the apertures (85, 87) after a portion of the mast 14 or other object has been inserted into the aperture 86 formed between the clamping arms 84. A clamping nut 93 is threaded onto the clamping bolt 89 to draw the clamping arms 84 into clamping engagement with the portion of the mast 14 or other object extending through the aperture 86. See FIG. 2. To facilitate easy tightening of the clamping nut 93 on the bolt 89, aperture 85 may have a non-circular shape that corresponds with a similarly-shaped portion of the clamping bolt 89. Such arrangement prevents the clamping bolt 89 from rotating relative to the clamping arms 84 as the clamping nut 93 is tightened thereon.

The attachment of the above-described embodiment of the mounting apparatus 10 of the present invention to a structure 11 will now be described. As discussed above, the structure 11 may comprise a portion of a building or other member, a tree limb, etc. The first structure attachment portion 32 of the first mounting leg 30 is placed in a desired orientation on the structure 11. Thereafter, the first attachment portion 32 is affixed to the structure 11 by inserting appropriate fasteners 90 through the mounting holes 34 therein. Similarly, the second structure attachment portion 42 is affixed to the structure 11 by inserting fasteners 95 through the mounting holes 44 in the second structure attachment portion 42. The skilled artisan will appreciate that the fasteners 95 may comprise a variety of different fasteners that are compatible with the structure 11. For example, if the portion of the structure 11 to which the mounting apparatus 10 is to be attached comprises wood such as a tree limb, appropriate wood screws may be employed. If, however, the structure is metal, appropriately sized self-tapping metal screws, bolts, etc. may be used. If the structure is concrete, appropriate concrete fasteners may be employed.

After the first structure attachment portion 32 and the second structure attachment portion 42 are affixed to the structure 11, the second bracket 50 is slidably positioned relative to the first and second attachment legs (30, 40) such that the collar-mounting portion 56 is a desired distance "E" from the structure 11. Thereafter, the self locking nuts (64, 78) are tightened to rigidly affix the second bracket 50 to the first mounting leg 30 and the second mounting leg 40.

The position of the collar 80 about the axis of rotation F—F is then adjusted and the nut 94 is tightened. Thereafter, the antenna mast 14 or other object is inserted into the aperture 86 between the clamping arms 94 and the clamping bolt 89 is inserted through the apertures (85, 87)in the clamping arms 84. The clamping nut 93 is screwed onto the clamping bolt 89 to bring the clamping arms 84 into clamping engagement with the mast 14 or other object. If desired, to ensure that the mast 14 is properly vertically oriented when clamped by the collar 80, the mast 14 can be temporarily installed in the collar 80 prior to locking the collar 80 in position. The mast 14 can then be vertically aligned utilizing known techniques. For example, a conventional level can be used to align the mast 14 along a vertical axis. After the mast 14 has been oriented in a desired position, the mast 14 may be removed from the collar 80 to enable the locking nut 94 to be tightened to retain the collar 80 in position. Thereafter, the mast 14 can be re-clamped to the collar 80 in the above-mentioned manner. In one embodiment of the present invention, all of the nuts (64, 78, 93, 94) are of a common size so that a single hand tool is required for installation and adjustment of the mounting apparatus 10. For example all of the fasteners (62, 76, 93) may comprise 5/16 inch carriage bolts and nuts (64, 78, 93, 94) may comprise 5/16 inch lock washers. In addition, fasteners 95 may be selected to have similarly sized heads depending upon the application.

If desired, two mounting apparatuses (10, 10') may be employed to support an antenna mast 14 relative to a structure 11. For example in the installation shown in FIG. 10, a mounting apparatus 10' that is identical in construction to mounting apparatus 10 is employed to support a mast 14 relative to a structure 11. When employing two mounting apparatuses, the upper mounting apparatus 10 may be installed first in the manner described above. After the collar 80 of the upper mounting apparatus 10 is aligned along a vertical axis by, for example, clamping the mast 14 in collar 80 and vertically aligning the mast 14 by applying a conventional leveling device thereto. The second or lower mounting apparatus 10' is aligned such that the collar 80' is aligned along the vertical axis. To align the collar 80' along the vertical axis, a plumb bob 81 is suspended from the upper collar 80. The lower mounting apparatus 10' is then manipulated such that the collar 80' is aligned along the vertical axis established by the plumb bob and the second mounting apparatus 10' is affixed to the structure 11 while maintaining such alignment. See FIG. 10A. The second bracket 50' is locked in position relative to the first bracket 20' in the above-mentioned manners and the collar 80' is also locked in position. The mast 14 may then be clamped in the collars (80, 80') in the manners described above.

Figure 10:
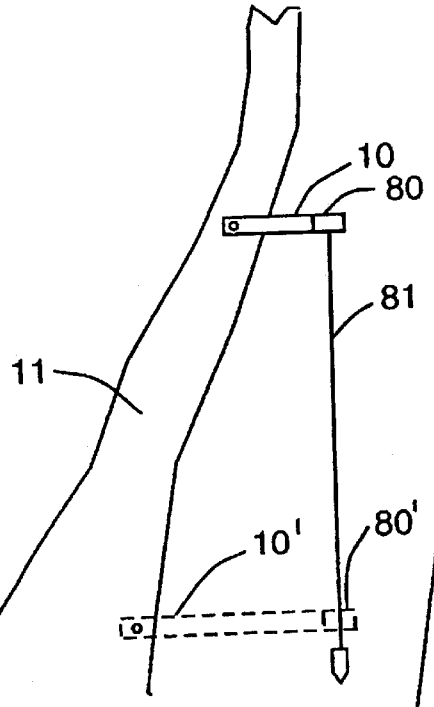
FIG. 10 is a side elevational view of a tree limb showing the use of a plumb bob to align the attachment collars of two mounting apparatuses of the present invention that are attached to the tree limb.
Figure 10A:
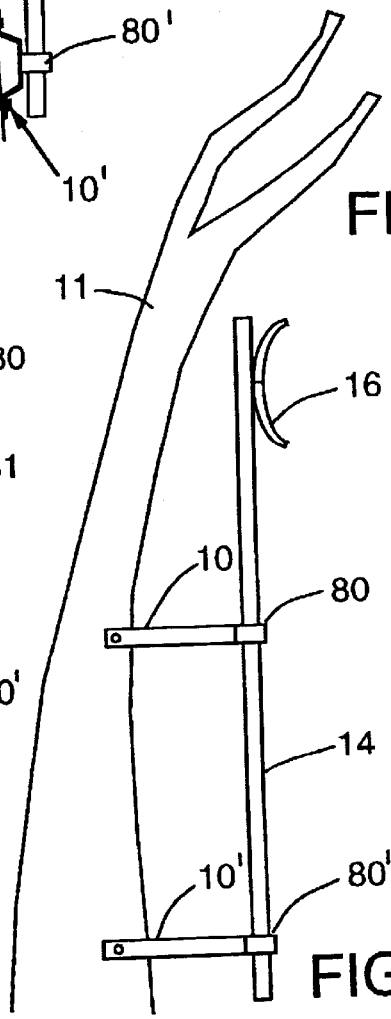
FIG. 10A is a side elevational view of the tree limb and mounting apparatuses depicted in FIG. 9 supporting an antenna mast therein.

Those of ordinary skill in the art will appreciate that any number of mounting apparatuses 10 of the subject invention may be employed to support a mast 14 or other object relative to a structure 11. It will be further appreciated that the structure mounting portions of the mounting legs may be bent such that they are substantially coplanar with their corresponding extension to facilitate attachment to a structure such as a round tree trunk or limb. See FIG. 9. FIGS. 9–12, depict the use of antenna mounting apparatuses of the present invention used to mount an antenna mast to a variety of different tree configurations. In FIGS. 10 and 10A, the upper mounting apparatus 10 is mounting to the tree branch in a substantially horizontal orientation while the lower mounting apparatus 10' is mounted in a vertical orientation. FIG. 10 depicts both mounting apparatuses (10, 10') mounted to a tree branch in vertical orientations. Thus, it is readily apparent that the mounting apparatus of the present invention can be used in a variety of different applications to affix an antenna mast 14 or other object to a variety of different structures.

Figure 13:
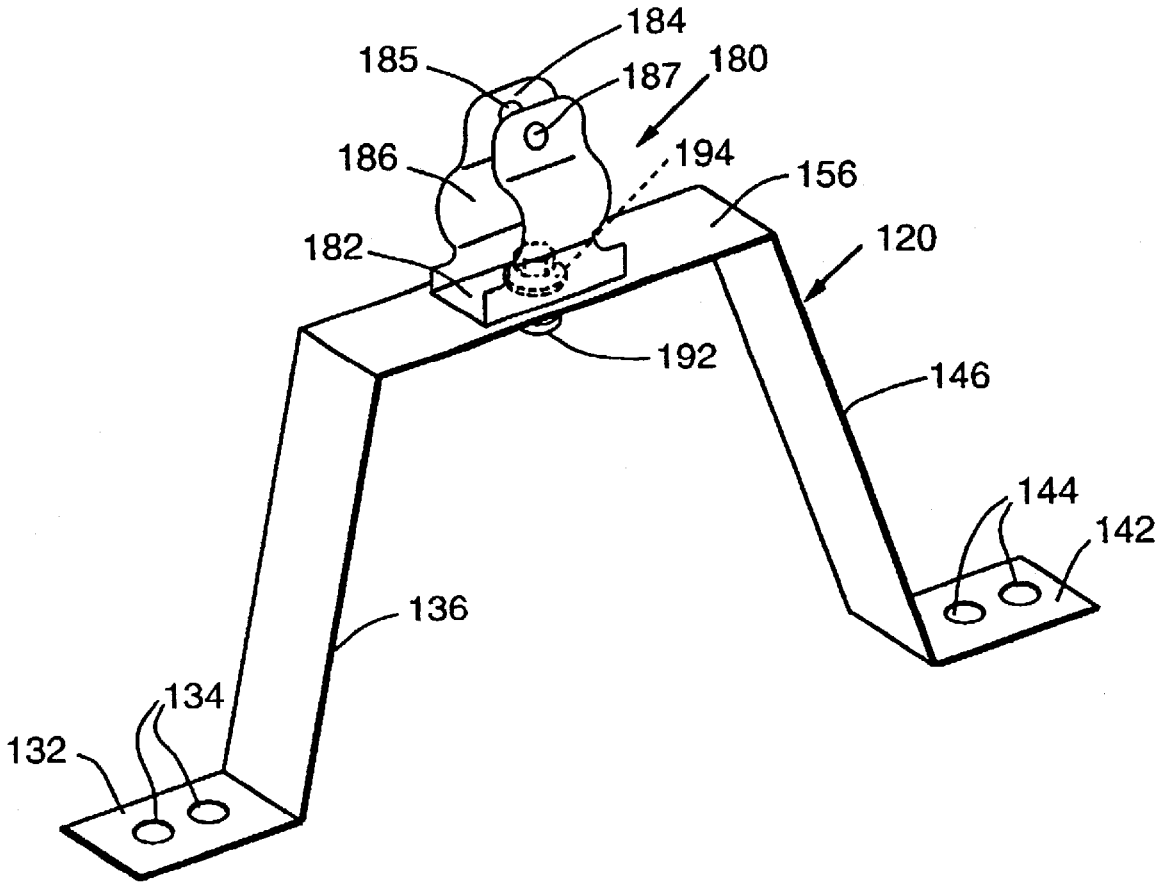
FIG. 13 is a perspective view of another embodiment of the mounting apparatus of the present invention.
Figure 14:
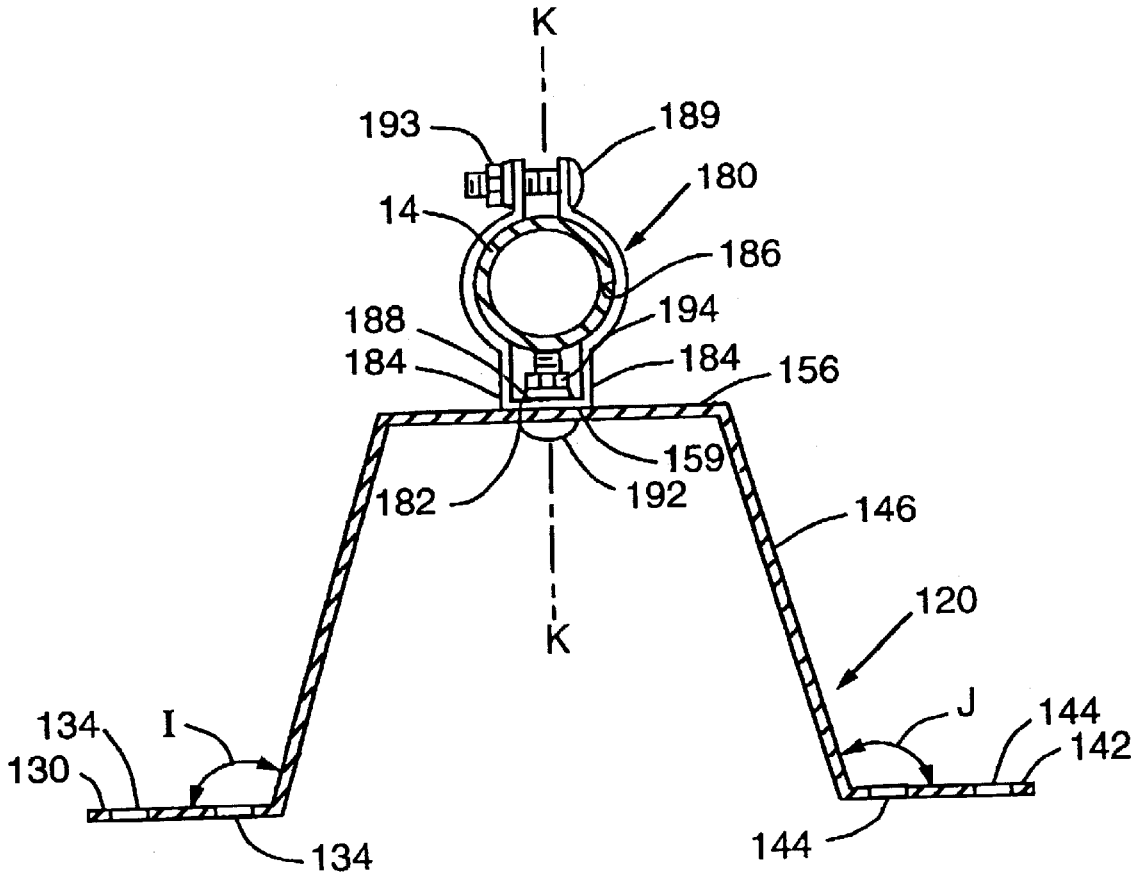
FIG. 14 is a top view of the mounting apparatus of FIG. 13 supporting an antenna mast which is shown in cross-section.
Figure 15:
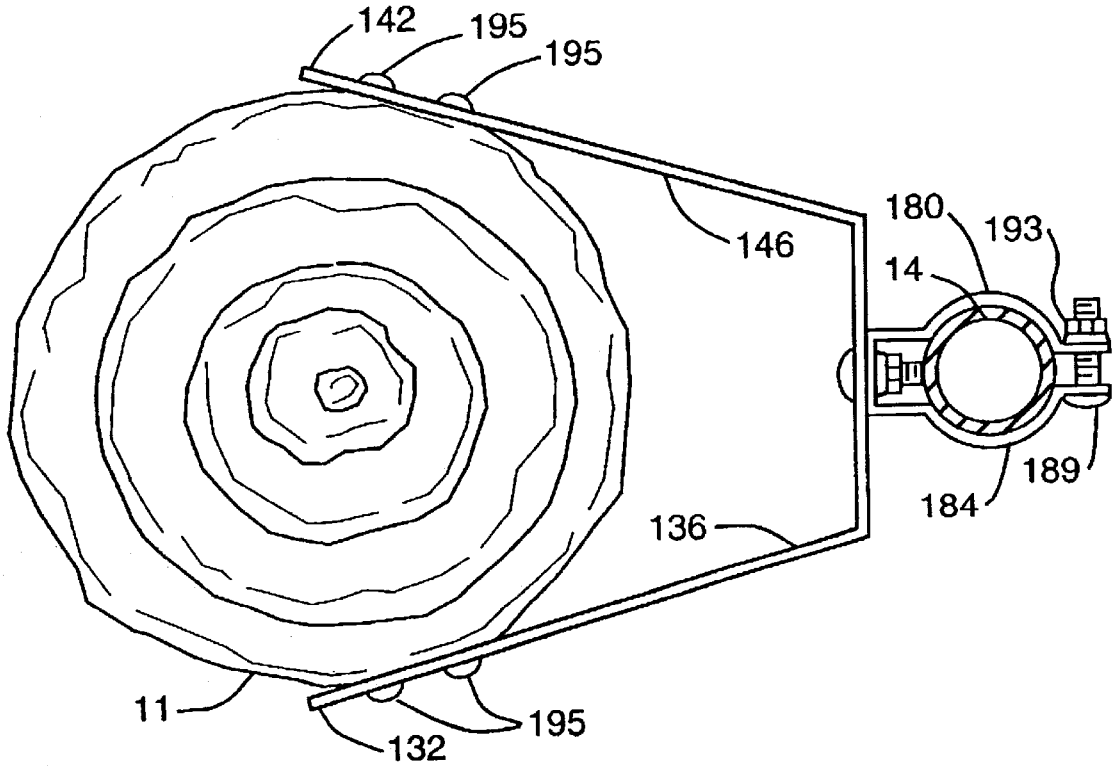
FIG. 15 is a top view of another embodiment of the mounting bracket of the present invention attached to a structure in the form of a tree limb which is shown in cross-section.

Another embodiment of the present invention is depicted in FIGS. 13 and 14 and includes a first bracket 120 that is configured for attachment to a structure 11. In this embodiment, the first bracket 120 includes a first structure attachment portion 132 that has at least one fastener hole 134 therethrough. Connected to one end of the first structure attachment portion 132 is a first extension portion 136. In this embodiment, the first extension portion 136 is oriented at an angle "I" relative to the first structure attachment portion 132. See FIG. 14. Angle "I" is 70°; however, angle "I" may have a variety of different sizes. As shown in FIG. 15, if desired, the first structure attachment portion 132, may be coplanar with the extension 136 where the size and shape of the structure dictates. A collar-supporting portion 156 extends laterally from one end of the first extension 136 and a second extension 146 is affixed to one end of the collar support portion 156. A second structure attachment portion 142 is attached to an end of the second extension 146 and at least one mounting hole 144 is provided therethrough. In this embodiment, the second extension 146 is oriented at angle "J" relative to the second structure attachment portion 142. Angle "J" is 70°; however, angle "J" may be provided in a variety of different sizes. If desired, as shown in FIG. 15, the second structure attachment portion 142, may be coplanar with the extension 146 where the size and/or shape of the structure dictates. First bracket 120 may b fabricated from a single piece of material that may be selectively bendable. For example, the first bracket 120 may be fabricated from 10 gage galvanized metal that is selectively bendable and corrosion resistant. However, other materials such as stainless steel may be employed.

In this embodiment, a collar or clamp 180 is employed to clamp the mast 14 to the first bracket 120. As can be seen in FIG. 14, the collar 180 has a base 182 and two clamping arms 184 that define an aperture 186 that corresponds to the perimetrical shape of the mast 14 or other object to be supported. For example, in the embodiment depicted in FIG. 14, the mast 14 has a circular-shaped perimeter. Thus, the aperture 186 has a circular shape that is sized to receive a portion the mast 14 therein. However, if the mast 14 or other object has a square, rectangular, triangular, octagonal, etc. shaped perimeter, the aperture 186 may be provided in a corresponding shape to facilitate rigid clamping of the mast 14 or other object between the clamping arms 184. In this embodiment, the collar 180 is fabricated from corrosion resistant material such as galvanized steel, stainless steel, polymeric material, etc.

Figure 13A:
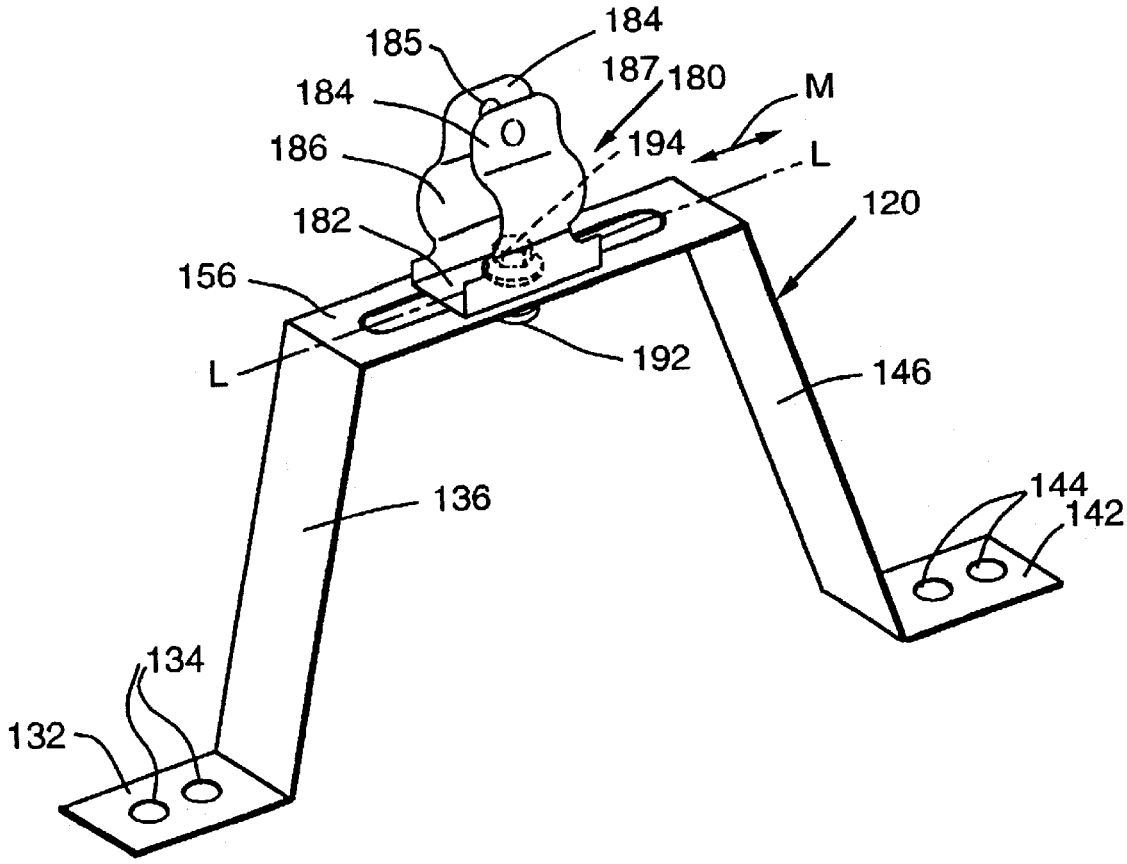
FIG. 13A is a perspective view of another embodiment of the mounting apparatus of the present invention.

A mounting hole 188 is provided through the base 182 of the collar 180. A fastener 190 extends through a hole 157 and through the mounting hole 188 in the base 182 of the collar 180. In this embodiment, the fastener 190 comprises a carriage bolt 192 and corresponding nut 194. As shown in Figure, the carriage bolt 192 defines an axis of rotation "K—K" about which the collar 180 can be selectively rotated during installation. See FIG. 14. In another embodiment shown in FIG. 13A, the collar 180 is rotatably and slidably affixed to the collar-mounting portion 156. An elongated collar slot 158 is provided through the collar-mounting portion 156. A fastener 190 extends through the collar slot 158 and through the mounting hole 188 in the base 182 of the collar 180. It will also be appreciated that, prior to tightening the nut 194, the collar 180 may be selectively laterally positioned relative to the first bracket 120 along a lateral axis "L—L" (defined by collar slot 158) as represented by arrow "M". Thus, after the collar 180 has been selectively oriented to a desired lateral position along axis L—L, and rotatably oriented about axis K—K to a desired position, the carriage bolt 192 and nut 194 are tightened to lock the collar 180 in that position. The skilled artisan will appreciate that in applications wherein the lateral positioning of the collar 180 is not required, a hole 159 may be provided in the collar-mounting portion 156 instead of the collar slot 158. See FIG. 14. Likewise, in those applications wherein it may not be necessary to rotate the collar 180 about an axis of rotation, the mounting hole 188 in the base 182 of the collar 180 may be shaped to correspond with a non-circular portion 193 formed on the carriage bolt 192 to prevent rotation of the collar 180 on the carriage bolt 192.

To facilitate clamping of the mast 14 or other object to the mounting apparatus 110, apertures (185, 187) are provided through the clamping arms 184 of the collar 180 as shown in Figure. A clamping bolt 189 is inserted through the apertures (85, 187) after a portion of the mast 14 or other object has been inserted into the aperture 186 formed between the clamping arms 184. A clamping nut 193 is threaded onto the clamping bolt 189 to draw the clamping arms 184 into clamping engagement with the portion of the mast 14 or other object extending through the aperture 186. To facilitate easy tightening of the clamping nut 193 on the bolt 189, aperture 185 may have a non-circular shape that corresponds with a similarly-shaped portion 191 of the clamping bolt 189. Such arrangement prevents the clamping bolt 189 from rotating relative to the clamping arms 184 as the clamping nut 193 is tightened thereon.

The attachment of the above-described embodiment of the mounting apparatus 110 of the present invention to a structure 11 will now be described. The structure 11 may comprise a portion of a building or other member, a tree limb, etc. The first structure attachment portion 132 is placed in a desired orientation on the structure 11. Thereafter, the first attachment portion 132 is affixed to the structure 11 by inserting appropriate fasteners 195 through the mounting holes 134 therein. Similarly, the second structure attachment portion 142 is affixed to the structure 11 by inserting fasteners 190 through the mounting holes 144 in the second structure attachment portion 42. The skilled artisan will appreciate that the fasteners 195 may comprise a variety of different fasteners that are compatible with the structure 11.

After the first structure attachment portion 132 and the second structure attachment portion 142 are affixed to the structure 11, if desired, a bending force may be applied to the collar-mounting portion 156 to bend the first bracket 120 into a desired shape wherein angles I and J are altered. The position of the collar 180 about the axis of rotation K—K is then adjusted and the nut 194 is tightened. Thereafter, the antenna mast 14 or other object is inserted into the aperture 186 between the clamping arms 194 and the clamping bolt 189 is inserted through the apertures (185, 187) in the clamping arms 184. The clamping nut 193 is screwed onto the clamping bolt 189 to bring the clamping arms 184 into clamping engagement with the mast 14 or other object. If desired, the mast 14 can be temporarily installed in the collar 180 prior to locking the collar 180 in position. The mast 14 can then be vertically aligned utilizing known techniques. For example, a conventional level can be used to align the mast 14 along a vertical axis. After the mast 14 has been oriented in a desired position, the mast 14 may be removed from the collar 180 to enable the locking nut 194 to be tightened to retain the collar 180 in position. Thereafter, the mast 14 can be reclamped to the collar 180 in the above-mentioned manner.

If desired, two mounting apparatuses 110 may be employed to support an antenna mast 14 relative to a structure 11 in the manners described above. It will be further appreciated that the structure mounting portions may be oriented bent such that they are substantially coplanar with their corresponding extensions to facilitate attachment to a structure such as a round tree trunk or limb. See FIG. 14.

Thus, from the foregoing discussion, it is apparent that the present invention solves many of the problems encountered when using prior mounting devices to install, for example, an antenna mast on a structure. In particular, the mounting apparatuses of the present invention may be used to affix an antenna mast or other object to a structure such as a building, tower, tree, etc. that lacks a vertically oriented surface. The mounting apparatuses of the present invention afford a plurality of different adjustments that can be easily made to adapt the mounting apparatus to a variety of different structures. A plurality of mounting apparatuses of the present invention may be attached to the structure to support an antenna mast or other elongated object at plural points along the structure. The subject mounting apparatuses may also be used in connection with conventional mounting devices wherein the unique and novel adjustability of the subject invention is not required at every point of attachment to the structure. Those of ordinary skill in the art will also appreciate that by employing like-sized bolts and nuts to adjustably affix the various components of the present mounting brackets together, installation and adjustment of the mounting devices may be accomplished with a single hand tool. Such advantage eliminates the requirement of numerous hand tools during installation and leads to improved safety during installation. The present installation brackets may also be fabricated from corrosion resistant materials that will withstand many years in the elements without deterioration. Also, some embodiments of the present mounting apparatus are fabricated from materials that are selectively bendable. Such unique characteristic enables the installer to conform the apparatus to a variety of differently shaped structures. While such characteristics and advantages of the subject invention represent advancements over prior mounting apparatuses, those of ordinary skill in the art will readily appreciate that the details, materials and arrangement of parts which have been herein described and illustrated in order to explain the nature of the invention may be made by the skilled artisan within the principle and scope of the invention as expressed in the appended claims.

What is claimed is:

1. An apparatus for mounting an antenna mast to a structure, said apparatus comprising:

a first bracket attachable to the structure;

a second bracket slidably affixed to said first bracket; and a mast-supporting collar movably affixed to said second bracket.

2. The apparatus of claim 1 wherein said mast-supporting collar is rotatably affixed to said second bracket.

3. The apparatus of claim 1 wherein said mast-supporting collar is rotatably and slidably affixable to said second bracket.

4. The apparatus of claim 1 wherein said first bracket comprises:

a first mounting leg attachable to the structure; and a second mounting leg attachable to the structure.

5. The apparatus of claim 4 wherein said first mounting leg has a first structure attachment portion and a first extension oriented at a first angle relative to said first structure attachment portion and said second mounting leg has a second structure attachment portion and a second extension oriented at a second angle relative to said second structure attachment portion and wherein said second bracket is slidably affixed to said first extension and said second extension.

6. The apparatus of claim 5 wherein said first extension has a first slot therein and wherein said second bracket is slidably affixed to said first extension by at least one first fastener extending through said first slot and a corresponding hole in said second bracket and wherein said second extension has a second slot therethrough and wherein said second bracket is slidably affixed to said second extension by at least one second fastener extending through said second slot and a corresponding hole in said second bracket.

7. The apparatus of claim 6 wherein each said first fastener comprises a first carriage bolt and a corresponding first self-locking nut and wherein each said second fastener comprises a second carriage bolt and a corresponding second self-locking nut.

8. The apparatus of claim 5 wherein said first structure attachment portion and said first extension are integrally formed from a selectively bendable material such that said first angle may be selectively altered by bending said first extension relative to said first structure attachment portion and wherein said second attachment portion and said second angled portion are integrally formed from said selectively bendable material such that said second angle may be selectively altered by bending said second angled portion relative to said first structure attachment portion.

9. The apparatus of claim 5 wherein said first structure attachment portion is substantially coplanar with said first extension and wherein said second structure attachment portion is substantially coplanar with said second extension.

10. The apparatus of claim 1 wherein said second bracket has a collar-mounting portion that has a collar slot therein and wherein said mast-supporting collar is affixed to said collar mounting portion by at least one fastener extending through said collar slot.

11. The apparatus of claim 10 wherein each said at least one fastener comprises a carriage bolt and lock nut.

12. The apparatus of claim 1 wherein said first bracket, said second bracket and said mast-supporting collar are fabricated from a corrosion resistant material.

13. An apparatus for mounting an antenna mast to a structure, said apparatus comprising:

a bracket assembly affixable to the structure, said bracket assembly having a collar-mounting portion selectively movable toward and away from the structure and lockable in a desired position a desired distance from the structure; and a mast-supporting collar rotatably affixed to said collar-mounting portion.

14. The apparatus of claim 13 wherein said mast-supporting collar is rotatably and slidably affixable to said collar-mounting portion of said bracket assembly.

15. An apparatus for adjustably supporting an antenna mast relative to a structure, said apparatus comprising:

a first bracket means affixable to the structure;

a second bracket means slidably affixed to said first bracket means; and means for rotatably and lockably supporting the antenna mast relative to said second bracket means.

16. An apparatus for adjustably supporting an antenna mast relative to a structure, said apparatus comprising:

a first mounting leg having a first attachment portion attachable to the structure and a first extension having a first slot therethrough;

a second mounting leg having a second attachment portion attachable to the structure and a second extension having a second slot therethrough;

a second bracket slidably affixed to said first extension by at least one first fastener extending through a portion of said second bracket and said first slot in said first extension, said second bracket slidably affixed to said second extension by at least one second fastener extending through another portion of said second bracket and said second slot in said second extension, said second bracket having a collar-supporting portion; and a mast-supporting collar slidably and rotatably affixed to said collar-supporting portion by a third fastener extending through a third slot in said collar-supporting portion and said mast-supporting collar.

17. An apparatus for mounting an antenna mast to a structure, said apparatus comprising:

a first mounting bracket non-rotatably attachable to the structure;

a mast-support collar rotatably affixed to said first mounting bracket for selective rotation about a first axis and being laterally slidable along a second axis; and a collar lock member attached to said first mounting bracket and said mast-support collar.

18. The apparatus of claim 17 wherein said first mounting bracket comprises:

at least one mounting leg affixable to the structure; and a collar support member spaced from said at least one mounting leg and affixed thereto.

19. The apparatus of claim 17 wherein said collar lock member comprises:

a first carriage bolt extending through an opening in said collar support member and defining said first rotation axis; and a nut affixable to said first carriage bolt.

20. The apparatus of claim 19 wherein said opening in said collar support member comprises a first slot.

21. The apparatus of claim 17 wherein said first mounting bracket comprises:

a first attachment leg;

a first extension leg portion attached to said first attachment leg and oriented at a first angle relative thereto;

a collar mounting portion attached to said first extension;

a second extension attached to said collar mounting portion; and a second attachment leg attached to said second extension at a second angle relative thereto.

22. The apparatus of claim 21 wherein said first attachment leg, said first extension leg portion, said collar mounting portion, said second extension, and said second attachment leg are integrally formed from a single material.

23. The apparatus of claim 21 wherein said first attachment leg and said second attachment leg lie along a common first plane and said collar mounting portion lies along a second plane that is substantially parallel to said common first plane.

24. The apparatus of claim 22 wherein said single material is flexible such that said first attachment leg and said first extension leg portion are selectively bendable relative to each other to enable said first angle to be selectively altered and wherein said second attachment leg and said second extension are selectively bendable relative to each other to enable said second angle to be selectively altered.

25. An apparatus for rigidly supporting an object relative to a structure, said apparatus comprising:

a first bracket attachable to the structure;

a second bracket slidably affixed to said first bracket; and an object supporting collar rotatably affixed to said second bracket.

26. The apparatus of claim 25 wherein said object supporting collar is rotatably and slidably affixed to said second bracket.

27. A method for supporting an antenna mast relative to a structure, said method comprising:

affixing a first mounting bracket to the structure, the first mounting bracket having a second bracket slidably affixed thereto and a mast-supporting collar rotatably affixed to the second bracket;

slidably orienting the second bracket relative to the first mounting bracket in a first predetermined lateral position;

locking the second bracket in said first predetermined lateral position;

rotatably orienting the mast-supporting collar in a second position;

locking the mast-supporting collar in said second position; and affixing the antenna mast to the mast-supporting collar.

28. The method of claim 27 wherein said rotatably orienting comprises orienting the mast-supporting collar such that when the mast is affixed thereto, the mast is parallel to a vertically extending axis.

29. The method of claim 27 wherein said affixing comprises clamping the antenna mast to the mast-supporting collar.

30. The method of claim 27 further comprising:

affixing a second mounting bracket to the structure, the second mounting bracket having a second mast-supporting collar;

aligning the second mast-supporting collar with the first mast supporting collar; and affixing the mast to the second mast-supporting collar.

31. The method of claim 30 wherein said aligning the second mast-supporting collar comprises:

suspending a plumb line from the first mast-supporting collar; and aligning the second mast-supporting collar along the plumb line.

32. The method of claim 30 wherein a secondary bracket is slidably affixed to the second mounting bracket and wherein said second mast-supporting collar is rotatably affixed to the secondary bracket and wherein said aligning said second mounting bracket comprises:

suspending a plumb line from the mast supporting collar; and slidably orienting the secondary bracket relative to the second mounting bracket to a second lateral position wherein the second mast-supporting collar is coaxially oriented along the plumb line; and locking the secondary bracket in the second lateral position.

33. The method of claim 32 wherein said aligning further comprises:

rotatably orienting the second mast-supporting collar such that the second mast supporting collar is coaxially aligned along the plumb line in a third position; and locking the second mast-supporting collar in the third position.

* * * * *